US006836919B2

(12) United States Patent
Shinler

(10) Patent No.: US 6,836,919 B2
(45) Date of Patent: Jan. 4, 2005

(54) SUSPENSION DEVICE FOR FLOOR MAINTENANCE APPLIANCE

(75) Inventor: Kevin L. Shinler, North Branch, MN (US)

(73) Assignee: Tennant Company, Minneapolis, MN (US)

( * ) Notice: Subject to any disclaimer, the term of this patent is extended or adjusted under 35 U.S.C. 154(b) by 185 days.

(21) Appl. No.: 10/153,408

(22) Filed: May 21, 2002

(65) Prior Publication Data

US 2002/0170131 A1 Nov. 21, 2002

Related U.S. Application Data

(60) Provisional application No. 60/292,683, filed on May 21, 2001.

(51) Int. Cl.[7] ..... E01H 1/02; E01H 1/04; A47L 11/00

(52) U.S. Cl. ..... 15/78; 15/50.1; 15/83; 15/340.4; 451/360

(58) Field of Search ..... 15/49.1, 50.1, 15/78, 87, 98, 82–83, 320, 340.3, 340.4; 451/353

(56) References Cited

U.S. PATENT DOCUMENTS

| | | | | |
|---|---|---|---|---|
| 3,204,280 A | | 9/1965 | Campbell | 15/314 |
| 4,492,002 A | | 1/1985 | Waldhauser et al. | 15/320 |
| 4,654,918 A | * | 4/1987 | Cooper | 15/98 |
| 4,757,566 A | | 7/1988 | Field et al. | 15/49 |
| 5,455,982 A | | 10/1995 | Armstrong et al. | 15/320 |
| 5,481,776 A | | 1/1996 | Briscoe | 15/49.1 |
| 5,483,718 A | | 1/1996 | Blehert et al. | 15/50.3 |
| 5,615,437 A | | 4/1997 | Takahashi et al. | 15/98 |
| 5,943,724 A | | 8/1999 | Erko et al. | 15/49.1 |
| 6,088,873 A | | 7/2000 | Pacchini et al. | 15/320 |
| 6,163,915 A | | 12/2000 | Kaczmarz et al. | 15/49.1 |
| 6,249,926 B1 | * | 6/2001 | Wulff | 15/50.1 |
| 6,530,102 B1 | * | 3/2003 | Pierce et al. | 15/52.1 |
| 6,618,888 B2 | * | 9/2003 | Joynt et al. | 15/49.1 |

FOREIGN PATENT DOCUMENTS

| | | |
|---|---|---|
| EP | 0910981 A1 | 4/1999 |
| WO | WO 96/12434 | 5/1996 |
| WO | 0074549 | 12/2000 |

* cited by examiner

*Primary Examiner*—Terrence R. Till
*Assistant Examiner*—Laura C Cole
(74) *Attorney, Agent, or Firm*—Fulbright & Jaworski L.L.P.

(57) ABSTRACT

A suspension device for coupling a surface maintenance appliance to a surface maintenance machine is disclosed. The suspension device includes a carriage member movably supported upon the maintenance machine through a plurality of linkages coupled to the carriage member. Together the plurality of linkages permit the carriage and surface maintenance appliance to follow undulations in the floor surface during operation of the surface maintenance machine. An actuator engages a lost motion device to lift the carriage member away from the ground surface. A variety of different floor surface maintenance appliances may be coupled to surface maintenance vehicles according to aspects of the present invention.

15 Claims, 6 Drawing Sheets

OPERATIVE CONDITION

SHOWN WITH HOPPER REMOVED

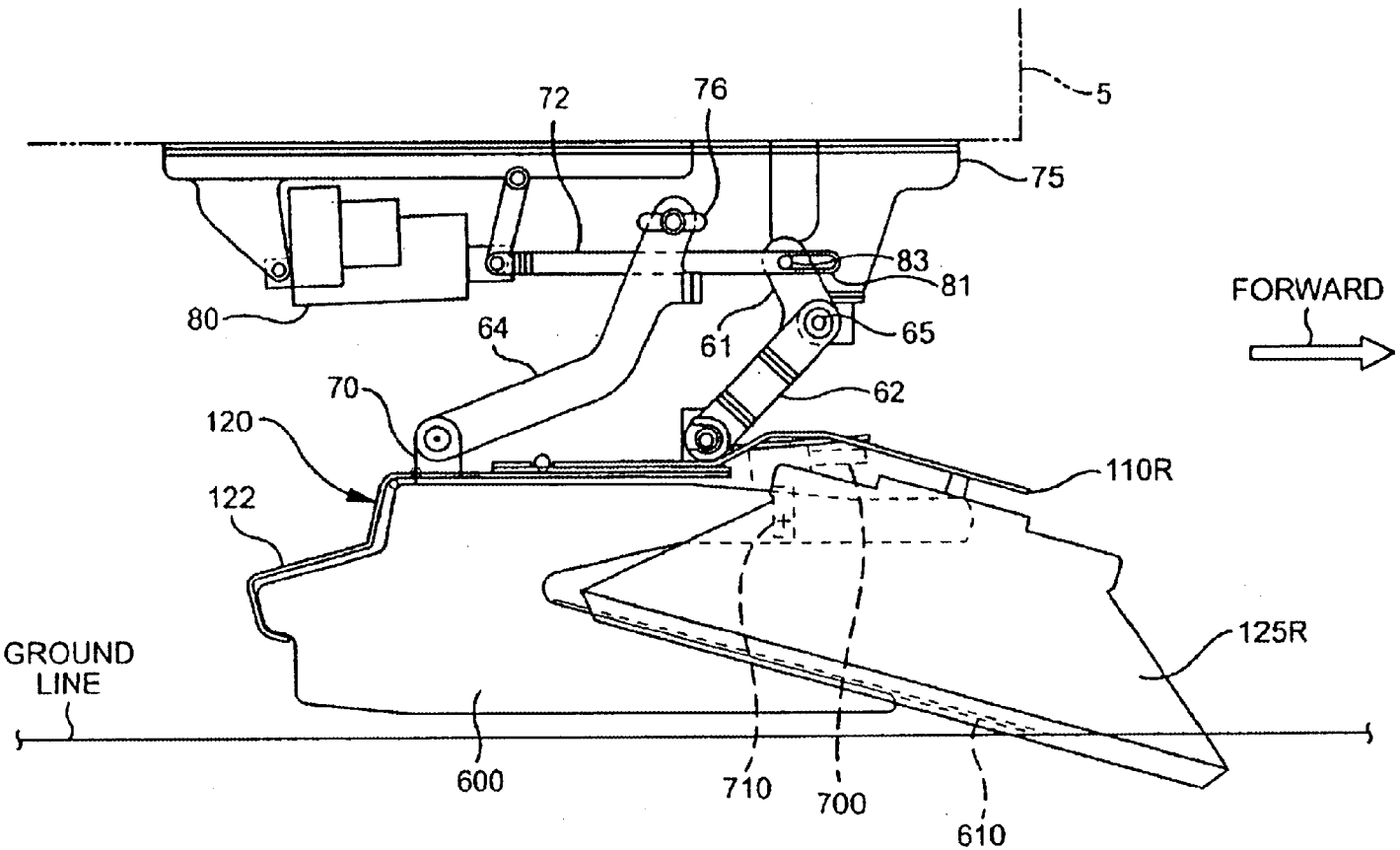
FIG. 4 OPERATIVE CONDITION

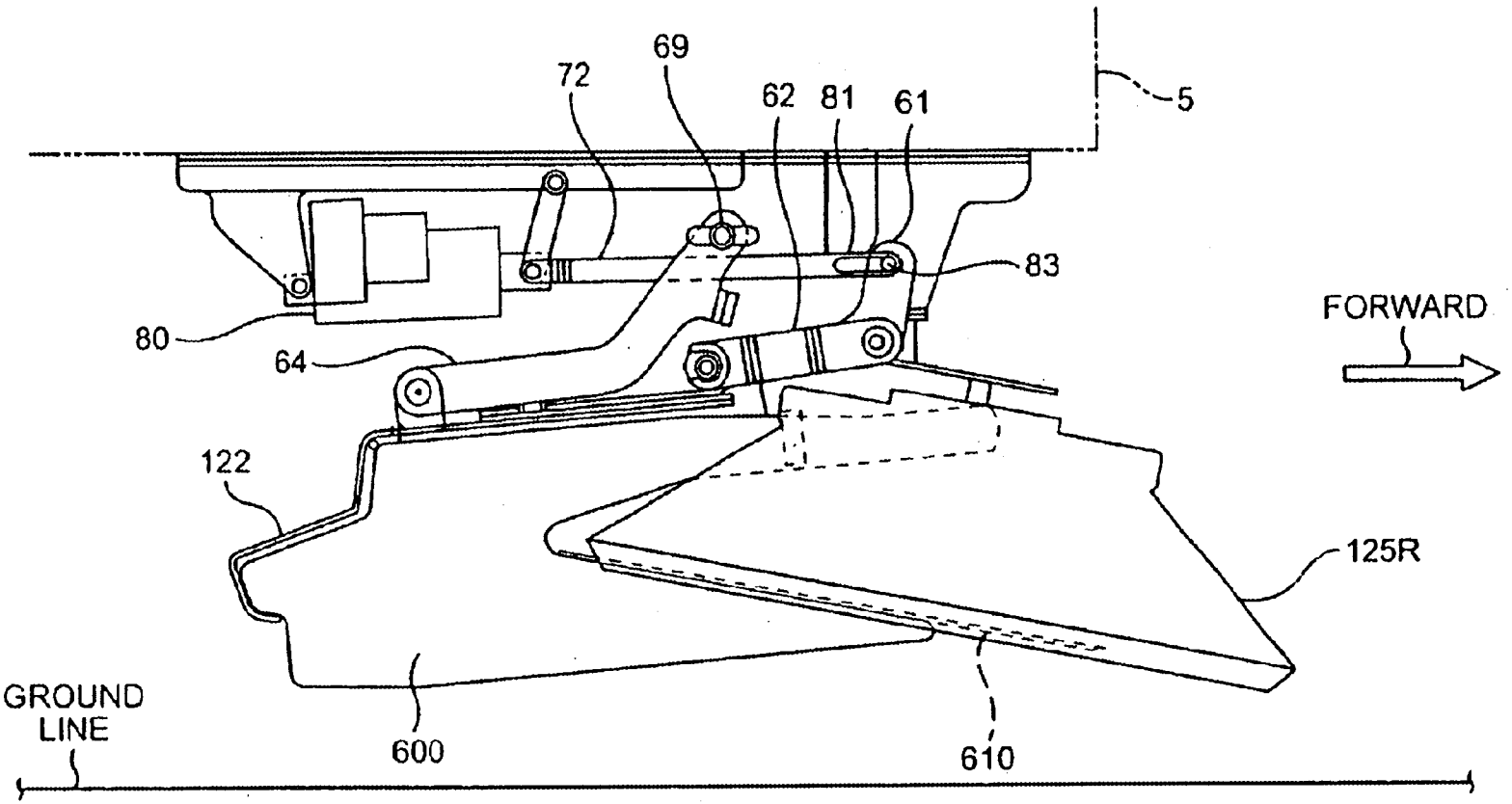
FIG. 5 RESPONSE CONDITION

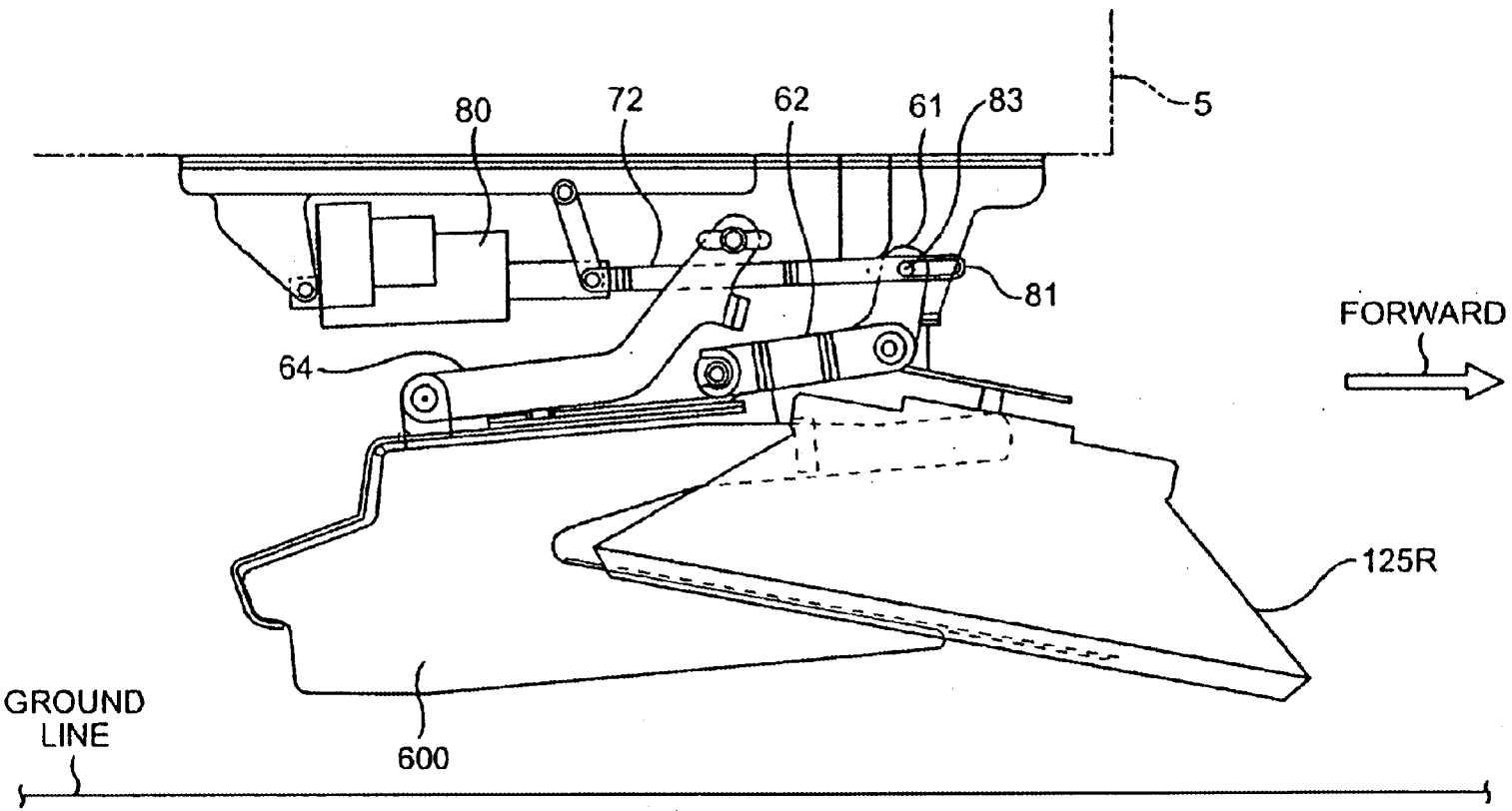
FIG. 6 TRANSPORT CONDITION

SUSPENSION DEVICE FOR FLOOR MAINTENANCE APPLIANCE

RELATED APPLICATION

This application claims the benefit of priority of U.S. Provisional Patent Application No. 60/292,683, filed on May 21, 2001, the disclosure of said application being incorporated by reference herein.

FIELD OF THE INVENTION

The present invention relates generally to floor maintenance or conditioning machines, and particularly those machines employing one or more floor maintenance or conditioning appliances or tools that perform one or more tasks including, among others, scrubbing, sweeping, and polishing or burnishing. More particularly the invention is directed to an apparatus for coupling a floor maintenance appliance to a floor maintenance machine.

BACKGROUND OF THE INVENTION

Surface maintenance machines that perform a single surface maintenance or surface conditioning task are, of course, well known. Surface maintenance machines are generally directed to applications such as floor surfaces, or simply floors. The term floor, as used herein, refers to any support surface, such as, among others, floors, pavements, road surfaces, ship decks, and the like.

Commonly floor or surface maintenance machines are constructed having a single surface conditioning appliance or system so as to only sweep, others to scrub, while still others only to polish or burnish. It is of course possible to construct a single surface maintenance machine to perform one or more of the aforementioned surface maintenance tasks.

One example of a multi-task floor or surface conditioning machine is disclosed in U.S. Pat. No. 3,204,280, entitled, "Floor Cleaning & Waxing Machine," issued to Campbell, the entire disclosure of which is incorporated by reference herein in its entirety for any and all purposes. Another is disclosed in U.S. Pat. No. 4,492,002 entitled, "Floor Cleaning Machine," in name of inventors Waldhauser, et al, the entire disclosure of which is incorporated by reference herein in its entirety for any and all purposes. Disclosed therein is a forward sweeper assembly followed by a scrubber assembly that is followed by a squeegee assembly.

Yet, another example of a multi-task floor conditioning machine is disclosed in a PCT applications having publication WO 00/74549, published 14 Dec. 2000, entitled, "Floor Cleaning Machine," in name of inventors Thomas, et al, the entire disclosure of which is incorporated by referenced herein in its entirety for any and all purposes. The machine disclosed therein performs the task of sweeping, scrubbing, and burnishing, and includes a squeegee assembly in combination with a vacuum system for removing cleaning solution from a floor subsequent to a cleaning and scrubbing operation.

As illustrated in WO 00/74549, thereshown is a single unitary walk-behind machine that is transportable across a floor. Successively attached to the machine, from front to back, are independent floor maintenance systems. At the forward section of the machine is a sweeping system. At the rearward section of the machine-machine steering control-is a burnishing system. In between the sweeping system and the burnishing system is a scrubbing system including forward scrubbing brushes coupled to a cleaning solution dispensing system and rearward following squeegees coupled to a liquid vacuum system for recovering expended cleaning solution.

Burnishing systems generally include a scheme for controlling the degree of burnishing applied to a floor surface depending upon the type of floor surface intended to be burnished. Burnishing systems well known in the art commonly include a driver assembly which includes a working appliance or tool such as a pad or brush affixed to a driver that is rotatably driven by a driver motor. The driver assembly of the burnishing systems of the prior art have been selectively raised and lowered by an actuator so as to achieve an intended force or pressure against a floor surface intended to be polished or burnished.

Scrubbing systems are analogous to burnishing systems, and are also well known in the art. Scrubbing systems commonly include a driver assembly including rotatable scrubber in the form of a brush, pad, or the like, and a scheme for controlling the degree of scrubbing applied to a floor surface depending upon the type of floor surface intended to be scrubbed. Too much scrubbing of course may deleteriously affect the floor surface requiring further maintenance. The scrubber driver assemblies for scrubbing systems, like burnishing systems, are of course well known in the art and commonly include one or more rotatable brushes driven by a driver motor affixed to a scrubber head. Scrubber heads of the prior art have been selectively raised and lowered by an actuator coupled to the driver so as to achieve an intended force or pressure of the brush against a floor surface intended to be scrubbed. Examples of the latter are taught in U.S. Pat. Nos. 4,757,566; 4,769,271; 5,481,776; 5,615,437; 5,943,724 and 6,163,915, each patent being incorporated in its entirety by reference herein.

Sweeper systems are also analogous to burnishing systems. Sweeper systems commonly include a rotatable sweeper system brush driven by a driver motor. Like burnishing and scrubbing systems the sweeper system brush may be lowered and raised relative to a floor, which may more or less affect the floor surface.

Commonly, floor conditioning machines are powered by a rechargeable battery supply. Of course, the battery voltage applied to the various floor conditioning systems or appliances, and particularly to the driver motor, will decay in relation to the energy discharged by the battery and the total time of discharge. With respect to burnishing systems, the mechanical burnishing power delivered to the floor is therefore dependent upon the voltage and current delivered to the driver motor.

Coupling devices including 4 bar linkages are known in the prior art to connect a working tool or appliance to a surface maintenance machine. One such device is disclosed in U.S. Pat. No. 5,455,985, the disclosure of which is incorporated in its entirety by reference herein.

SUMMARY OF THE INVENTION

An overhead suspension system for a floor maintenance appliance is disclosed herein. In one exemplary embodiment of the present invention, an overhead suspension system may be utilized to suspend a brush assembly and a hopper assembly from a floor maintenance machine. In an exemplary embodiment of the present invention, the brush and hopper assemblies can be transitioned away from a floor surface upon contact with an obstacle or surface irregularity, substantially preventing damage to the brushes or hopper. Because the suspension is overhead, the brushes and hopper can be lifted up into the boundaries of the frame of the floor maintenance apparatus, avoiding being damaged.

An objective of the present invention is to provide an overhead suspension system that is responsive to surface obstacles to obviate damages to the machine.

Another objective of the invention is to provide an overhead suspension system that is simple to maintain and fabricate.

Another object of the present invention is an overhead suspension system which may be utilized to couple a variety of different floor maintenance appliance to a floor maintenance machine

BRIEF DESCRIPTION OF THE DRAWINGS

FIG. 4 is a wire design drawing illustrating a side view of the sweeper system in accordance with the present invention in the normal operative condition.

FIG. 5 is a wire design drawing illustrating a side view of the sweeper system in accordance with the present invention in an obstacle response position.

FIG. 6 is a wire design drawing illustrating a side view of the sweeper system in accordance with the present invention in the transport position.

DETAILED DESCRIPTION OF THE INVENTION

Figure 1:
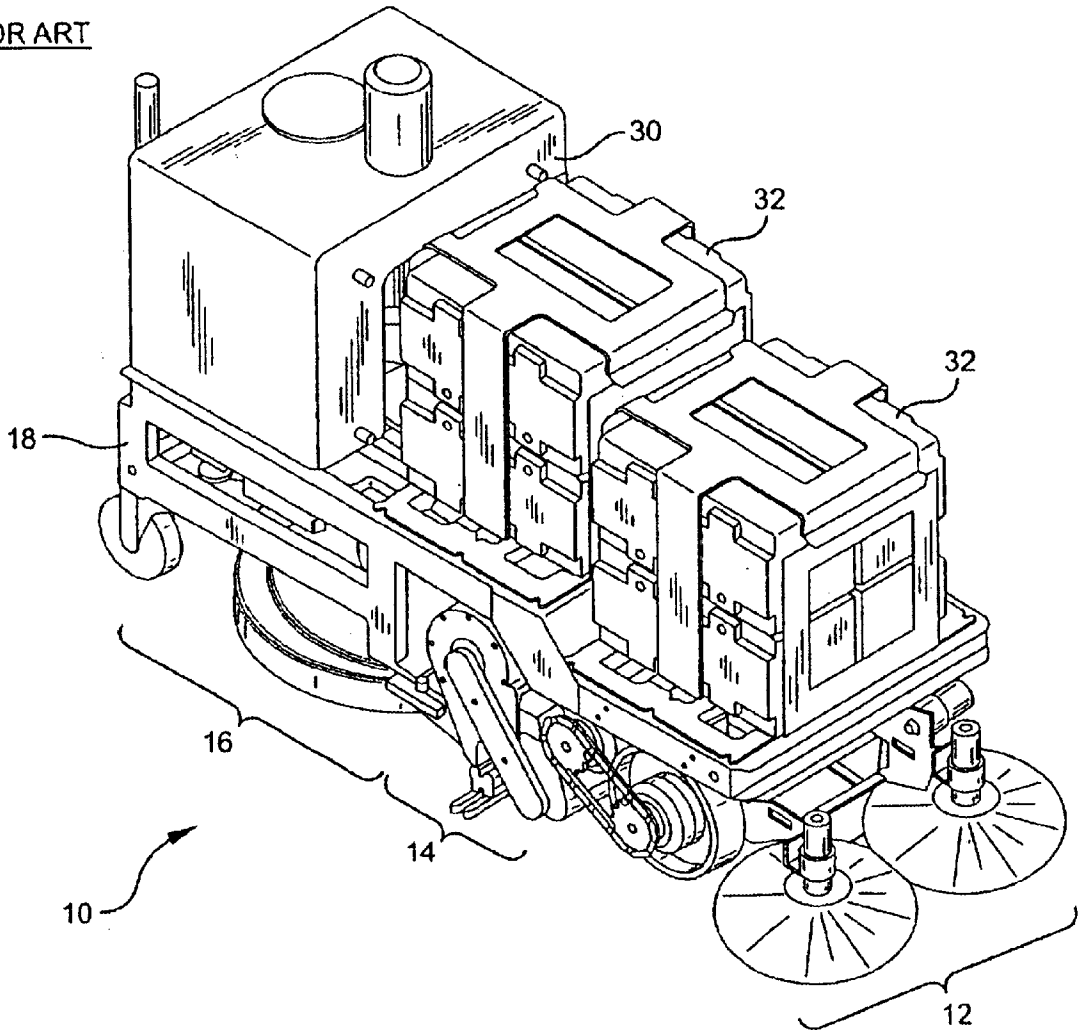
FIG. 1 PRIOR ART
FIG. 1 is a perspective view of a multi-task surface maintenance machine of the prior art illustrating a front sweeper system followed by a scrubber system, followed by a burnishing system illustrated in WO 00/74549.
Figure 2:
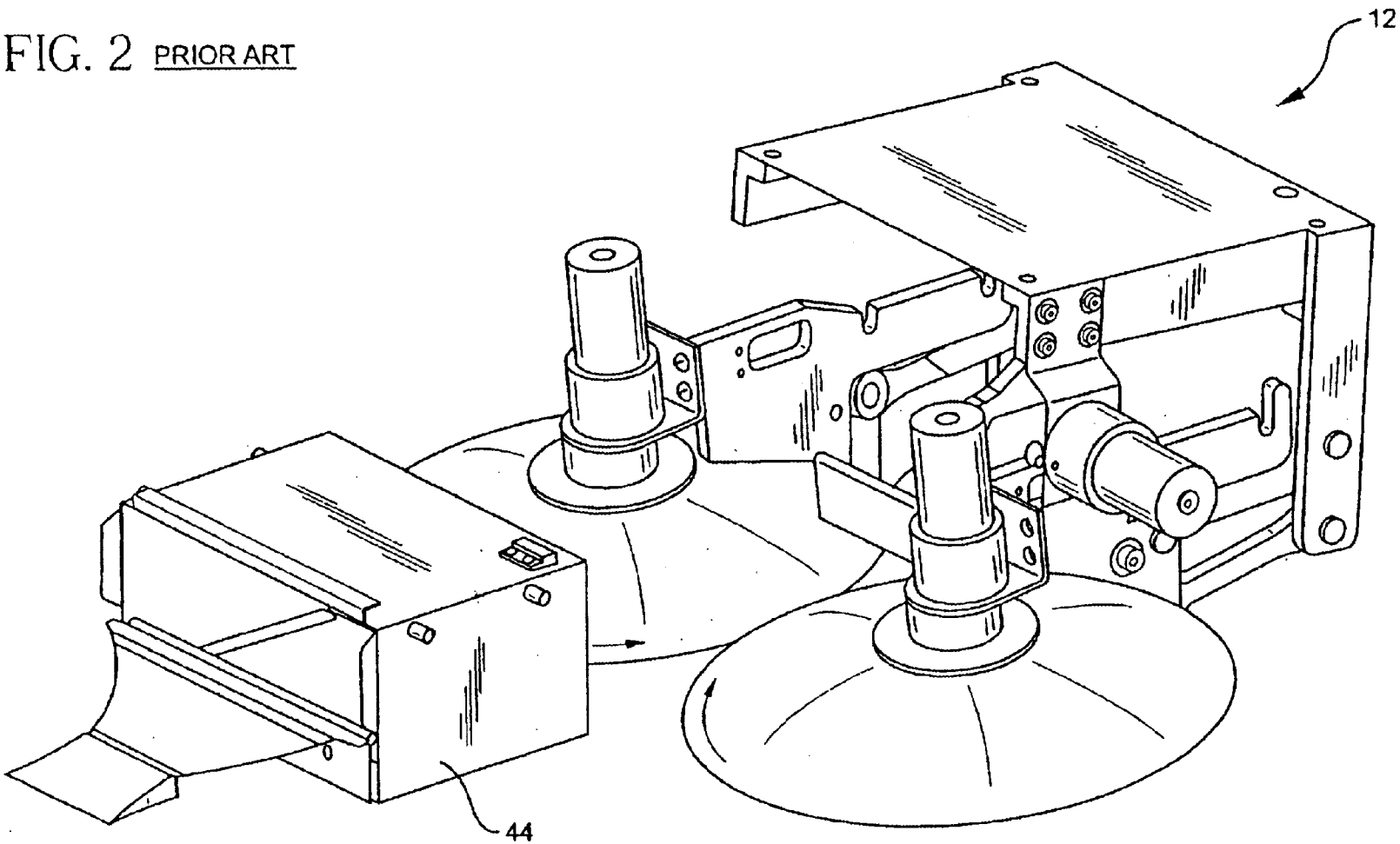
FIG. 2 PRIOR ART
FIG. 2 is a perspective view of the prior art sweeper system illustrated in WO 00/74549.

Illustrated in FIG. 1 is a walk behind surface conditioning machine 10 known in the art and disclosed in WO 00/74549. A burnishing assembly generally indicated by numeral 16, scrubbing assembly 14, and sweeping assembly 12 are separately controlled and suspended from a frame 18 by way of independent suspension systems. FIG. 2 more particularly illustrates the sweeper system or assembly including hopper 44. An embodiment of the present invention may be adapted to be utilized in such a prior art machine to couple a surface maintenance appliance, such as scrubbing assembly 14, sweeping assembly 12, and/or burnishing assembly 16 to machine 10. It may be appreciated that other embodiments of the present invention may be utilized on other types or styles of machines to couple a surface maintenance appliance thereto.

Figure 3:
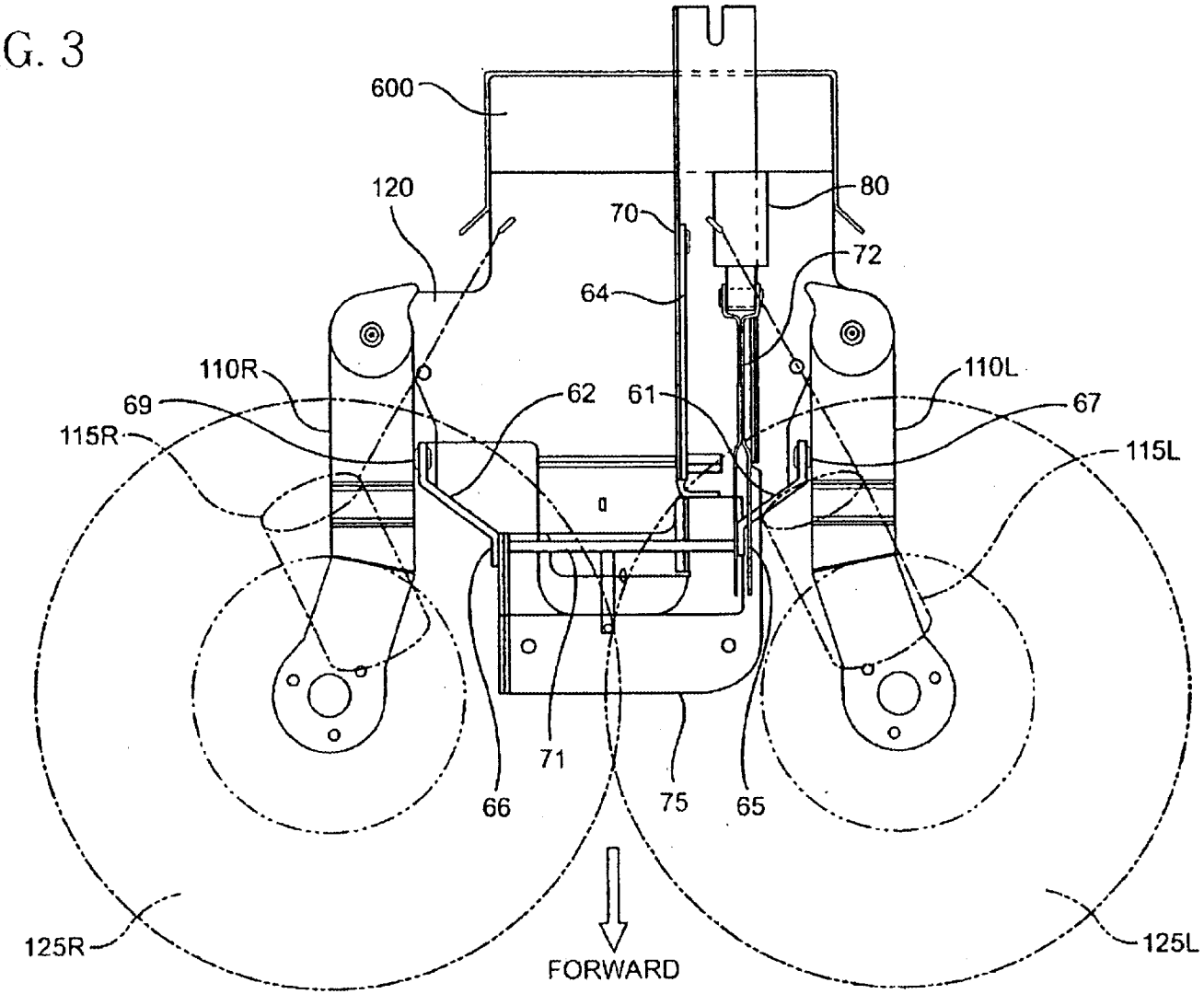
FIG. 3 is a wire design drawing illustrating a plan view of the sweeper system in accordance with the present invention.

Illustrated in FIGS. 3–4 are various perspectives, views, and drawings of one embodiment of the sweeper and hopper system in accordance with the present invention. Referring to FIG. 3, a pair of arms 110L and 110R are pivotally mounted at one end to brush carriage member 120. The other ends of arms 110L and 110R provide mounting members for attaching rotatable brushes 125L and 125R driven by independent drive motors 115L and 115R respectively. FIG. 4 shows a hopper support member 122 secured to brush carriage member 120 for supporting hopper 600 at one end. The other end of hopper 600 is secured to carriage member 120 by way of a spring loaded pin arrangement 700 as more particularly illustrated in FIG. 4 by way of a mating pin 710 secured to hopper 600. Additional aspects of the particular sweeper and hopper system illustrated in the drawings are disclosed in Applicant's U.S. Pat. Application filed on May 29, 2002, entitled "Sweeping System with Removable Hopper," Ser. No. 10/159,727 and claiming the benefit of priority of U.S. Provisional Patent Application Ser. No. 60/294,298. The entire disclosures of these two applications are incorporated by reference herein.

Brush carriage member 120 is pivotally attached to a bracket 75 intended to be mounted to a frame member 5 of the surface maintenance machine (not shown) by way of a 4-point overhead suspension system including support members or linkages 61, 62 and 64 as shown in FIGS. 3 and 4. Linkage 64 is pivotally mounted to slotted hole 76 of bracket 75 and is pivotally mounted at the opposite end to the hopper support member 122 by a pin extending through mounting bracket 70. Slotted hole 76 is for adjustment of linkage 64. Once linkage 64 is pivotally mounted at a point in slotted hole 76 there will not be translational movement along the slot. Linkage 61 is pivotally mounted to bracket 75 by pivot pin 71 extending through mounting bracket 65. An upper end of linkage 61 is coupled to actuator linkage 72 through a "lost motion"device which permits actuator 80 to selectively engage linkage 61. In the illustrated embodiment, lost motion device includes slot 81 and pin 83. Alternative lost motion devices which permit selective engagement of linkage 61 to actuator 80 would be appreciated by those skilled in the relevant arts, including for example cable or chain devices. An opposite end of actuator linkage 72 is coupled to actuator 80. The opposite end of linkage 61 is pivotally mounted to carriage 120 by a pin extending through mounting bracket 67. Linkage 62 is pivotally mounted to bracket 75 by one end of pivot pin 71 which extends through mounting bracket 66 and 65. The opposite end of linkage 62 is pivotally mounted to carriage 120 by a pin extending through mounting bracket 69.

The overhead suspension system is intended to be responsive to surface obstacles to obviate damage which may be imparted to the sweeper system if a surface obstacle or surface irregularity is encountered by the hopper lip 610 as shown in FIG. 4. FIG. 4 illustrates the normal operative condition with brushes 125 in contact with a floor surface. In the normal operative condition, carriage 120 follows surface undulations and brushes 125 remain in contact with the floor surface. Upon contact with an obstacle, such as a floor joint, crack, etc., carriage 120 is biased into a response condition. The overhead suspension system FIG. 5 illustrates a position of the overhead suspension system after response to the hopper lip 610 encountering an obstacle or surface irregularity. In an exemplary embodiment, hopper lip 610 flexes upon contacting an obstacle and tends to bias carriage 120 upwardly and rearwardly relative to the floor surface and direction of motion. As a result, the overhead suspension system lifts the hopper 600 and the brushes 125L and 125R together in a direction upwards and towards the back of the floor maintenance apparatus when the hopper lip 610 encounters an obstacle or surface irregularity. As the overhead suspension system lifts into the response position of FIG. 5, links 61, 62, and 64 are retracted to the extent of the severity of an obstacle or surface irregularity.

By providing an overhead suspension system, the entire brush and hopper assembly (125, 600) can be automatically biased up and away from an obstacle when the hopper lip 610 comes into contact with the obstacle or surface irregularity, substantially preventing damage to the brushes 125L and 125R or hopper 600. Because the suspension is overhead, the brushes 125L and 125R and hopper 600 can be lifted up into the boundaries of the frame of the floor maintenance apparatus. In addition, upon the obstacle being passed, the brush and hopper assembly is automatically lowered back into a normal operational position.

FIG. 6 illustrates the position of the hopper 600 and rotatable brushes 125L and 125R during transport. During a lift operation, actuator 80 is extended to engage link 61 which in turn causes links 61, 62 and 64 to rotate and translate the hopper 600 and rotatable brushes 125L and 125R up and clear of the ground surface. Once at a desire location, actuator 80 can be retracted to cause links 61, 62, and 64 to rotate and in turn lower the hopper 600 and rotatable brushes 125L and 125R to the ground surface for subsequent operation.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A suspension device for coupling a surface maintenance appliance to a surface maintenance machine, said suspension device comprising:

a carriage member;

a surface maintenance appliance coupled to the carriage member;

a plurality of linkages coupled to the carriage member, each of the plurality of linkages having a pair of ends, wherein one end of each of the plurality of linkages is pivotally coupled to the surface maintenance machine, and the other end of each of the plurality of linkages is pivotally coupled to the carriage, and wherein at least two of the linkages are non-parallel and have substantially different lengths measured between the pair of ends; and an actuator engaging one of the plurality of linkages through a lost motion device to lift the carriage member away from the ground surface, said lost motion device permitting the carriage and the surface maintenance appliance to follow undulations in the floor surface during operation of the surface maintenance machine.

2. The suspension device of claim 1 wherein the surface maintenance appliance includes a brush assembly and a hopper assembly.

3. The suspension device of claim 2 wherein the hopper assembly includes a hopper lip which is in ground surface engagement during operation of the surface maintenance machine.

4. The suspension device of claim 1 wherein the plurality of linkages comprises 3 linkages.

5. The suspension device of claim 1 wherein one of the plurality of linkages is engaged by an actuator which is generally horizontally aligned when the surface maintenance machine is on level ground.

6. The suspension device of claim 1 wherein the plurality of linkages comprises linkages which are pivotably coupled at their ends to the carriage member and the surface maintenance machine via pivot joints which generally permit rotation about axes of rotation which are transverse to a direction of machine motion.

7. The suspension device of claim 1 wherein the lost motion apparatus comprises a slot element and a pin element which engages said slot element.

8. The suspension system of claim 1 wherein the plurality of linkages are coupled between the carriage member and the surface maintenance machine through a plurality of pivot joints.

9. A suspension device for coupling a surface maintenance appliance to a surface maintenance machine, said suspension device comprising:

a carriage member;

a surface maintenance appliance coupled to the carriage member;

a plurality of linkages coupled to the carriage member, each of the plurality of linkages having a pair of ends, wherein one end of each of the plurality of linkages is pivotally coupled to the surface maintenance machine, and the other end of each of the plurality of linkages is pivotally coupled to the carriage, wherein the plurality of linkages are of substantially different lengths and together the plurality of linkages permit the carriage and surface maintenance appliance to follow vertical undulation in the floor surface during operation of the surface maintenance machine while restraining the carriage and surface maintenance appliance from movement in a horizontal direction which is transverse to a direction of surface maintenance machine movement, and an actuator engaging at least one of the plurality of linkages to lift the carriage member away from the ground surface.

10. The suspension device of claim 9 wherein the surface maintenance appliance includes a brush assembly and a hopper assembly.

11. The suspension device of claim 10 wherein the hopper assembly includes a hopper lip which is in ground surface engagement during operation of the surface maintenance machine.

12. The suspension device of claim 9 wherein the plurality of linkages comprises 3 linkages.

13. The suspension device of claim 9 wherein the actuator engages the at least one of the plurality of linkages through a lost motion apparatus.

14. The suspension device of claim 13 wherein the lost motion apparatus comprises a slot element and a pin element which engages said slot element.

15. A method of suspending and lifting a surface maintenance appliance to a surface maintenance machine, said method comprising the steps of:

coupling the surface maintenance appliance to the surface maintenance machine with a suspension device comprising: a carriage member; a surface maintenance appliance coupled to the carriage member; a plurality of linkages coupled to the carriage member, each of the plurality of linkages having a pair of ends, wherein one end of each of the plurality of linkages is pivotally coupled to the surface maintenance machine, and the other end of each of the plurality of linkages is pivotally coupled to the carriage, together the plurality of linkages are non-parallel and have substantially different lengths and permit the carriage and surface maintenance appliance to follow undulations in the floor surface during operation of the surface maintenance machine;

providing an actuator which engages at least one of the plurality of linkages;

engaging the actuator to lift the carriage member away from the ground surface;

engaging the actuator to lower the carriage member toward the ground surface;

operating the surface maintenance appliance to perform a surface maintenance procedure across a floor surface having undulations and obstacles;

permitting the surface maintenance appliance to maintain contact with the floor surface as the machine travels across said undulations; and permitting the surface maintenance appliance to be biased away from the floor surface upon contact with the obstacles so that the machine can pass over the obstacles.

* * * * *